United States Patent [19]

Dudek et al.

[11] 4,198,273

[45] Apr. 15, 1980

[54] APPARATUS FOR PRODUCING PETROLEUM COKE CALCINATE

[75] Inventors: Max Dudek; Otto Tieke, both of Lingen, Fed. Rep. of Germany

[73] Assignee: Wintershall Aktiengesellschaft, Fed. Rep. of Germany

[21] Appl. No.: 924,081

[22] Filed: Jul. 12, 1978

Related U.S. Application Data

[62] Division of Ser. No. 817,115, Jul. 18, 1977.

[30] Foreign Application Priority Data

Jul. 28, 1976 [DE] Fed. Rep. of Germany ..... 2633789

[51] Int. Cl.[2] ..... C10B 1/10

[52] U.S. Cl. ..... 202/136; 202/150; 432/106

[58] Field of Search ..... 201/25, 27, 32, 33, 201/14, 15, 28; 202/100, 131, 136, 216, 82, 93, 94, 95, 150, 229; 432/13, 14, 15, 58, 106; 208/50, 53; 423/448, 460, 461

[56] References Cited

U.S. PATENT DOCUMENTS

| | | | |
|---|---|---|---|
| 2,927,062 | 3/1960 | Reintjes | 201/25 X |
| 3,173,852 | 3/1965 | Smith | 201/28 X |
| 3,595,542 | 7/1971 | Ashman | 432/16 X |
| 3,759,795 | 9/1973 | Oliver et al. | 201/25 |
| 3,867,261 | 2/1975 | Solano | 202/100 X |
| 3,888,621 | 6/1975 | Williams | 201/32 X |
| 4,012,202 | 3/1977 | Byrne et al. | 202/95 X |

*Primary Examiner*—Joseph Scovronek
*Assistant Examiner*—Roger F. Phillips
*Attorney, Agent, or Firm*—Haseltine, Lake & Waters

[57] ABSTRACT

Green petroleum coke is indirectly dried, than calcined in a cylindrical rotary kiln and indirectly cooled utilizing a one-way gas flow in the system. Most of the dust in the vapor from the drying step is directly burned in a steam boiler whose off-gases are used to heat the dryer. Any residual dust in the gas is collected in an electro-filter. This dust together with dust which settles out from the dryer and the kiln is collected and added in controlled amounts to the dried coke before calcining. Hydrocarbons expelled during calcining are partially burned off with a stream of secondary air introduced at the coke exit end of the kiln. Most of the remaining hydrocarbons are burned off before they leave the coke inlet end of the kiln. The calcined coke product contains 0.1% by weight of hydrocarbons. The final off-gas from the process has a residual dust content of less than 100 mg/nm$^3$.

3 Claims, 1 Drawing Figure

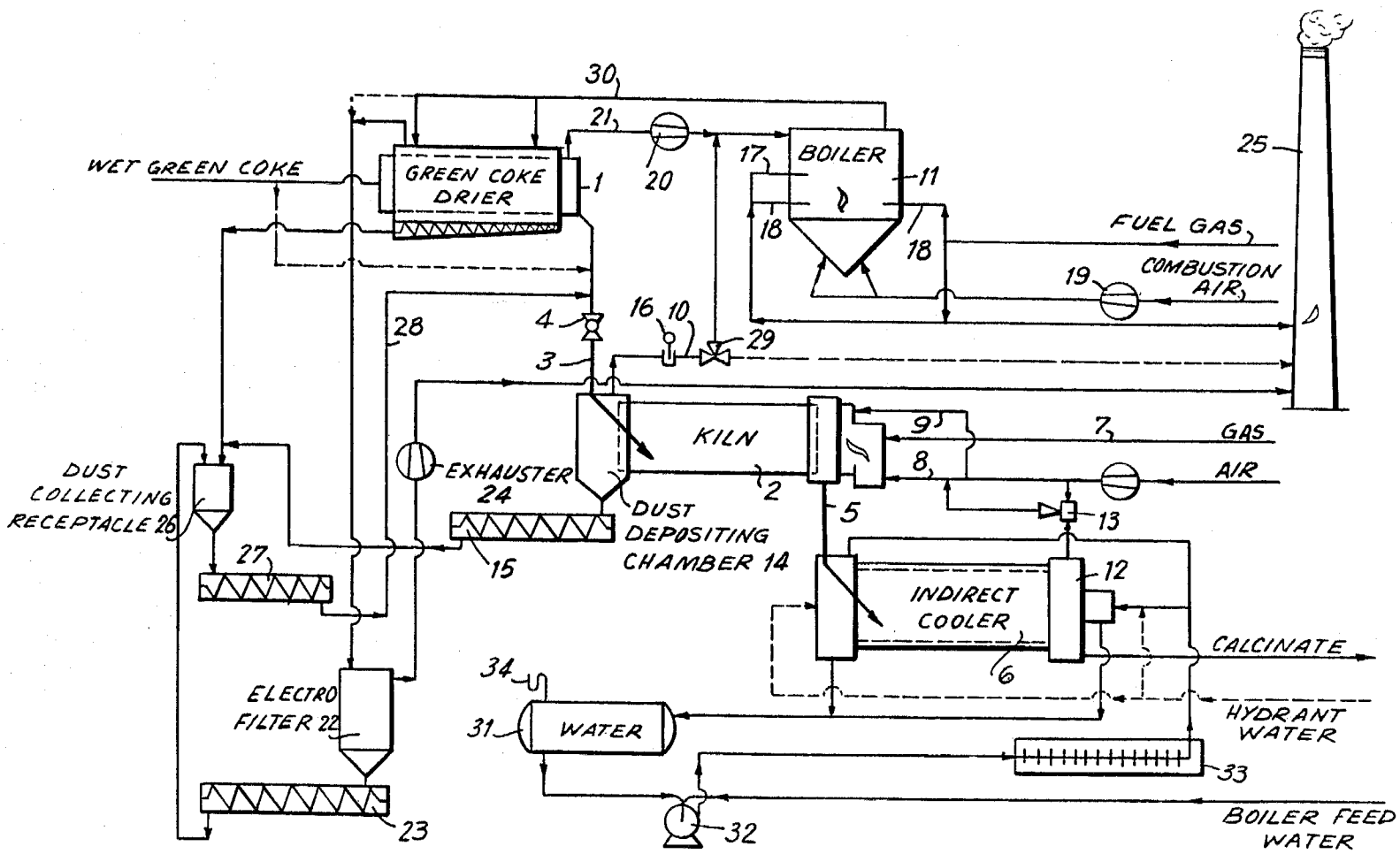
25
FUEL GAS
COMBUSTION AIR
GAS
AIR
CALCINATE
HYDRANT WATER
BOILER FEED WATER
BOILER
KILN
INDIRECT COOLER
DUST DEPOSITING CHAMBER 14
EXHAUSTER 24
GREEN COKE DRIER
WATER
ELECTRO FILTER 22
WET GREEN COKE
DUST COLLECTING RECEPTACLE 26

APPARATUS FOR PRODUCING PETROLEUM COKE CALCINATE

This is a division of application Ser. No. 817,115 filed July 18, 1977 issue May 19, 1979.

BACKGROUND OF THE INVENTION

In the thermal cracking of distillation residues or heavy gas oil fractions obtained in the processing of crude oil, petroleum coke is formed which is separated in coking chambers and cut out by means of pressure water jets.

The crude coke, which is also called green coke, still contains 6–15% of heavy, asphalt-type hydrocarbons and 12–20% water depending on the duration of storage.

The coke is primarily used for the production of electrodes. However, this production requires the removal of the water and the hydrocarbons from the green coke, for which purpose the green coke is heated to temperatures within the range of 1200°–1400° C., which reduces the specific electric resistance of the petroleum coke from $3.7\times10^6\Omega$/cm to 0.014 to 0.016 $\Omega$/cm. The coke is converted by an isolator into an electric conductor.

According to the present state of the art, the calcining is carried out in rotating hearth-type furnaces or in cylindrical rotary kilns, but discontinuously operated pit furnaces are also in use. However, the number of cylindrical rotary kilns substantially exceeds the number of rotary-table installations. For production capacities in excess of 500 tons/day, cylindrical rotary kilns are exclusively used. On the whole, the cylindrical rotary kiln has an advantage over the rotary-table furnace inasmuch as it allows for more processing variations, so that the manifold, continuously growing demands upon the quality of the calcinate may be satisfied.

The following description thus relates to the use of a cylindrical rotary kiln according to the present state of the art.

The wet green coke is placed into the cylindric rotary kiln which is slightly inclined. The charge is slowly conveyed through the furnace by the rotation of the kiln. At the product discharge side, the kiln is heated from the head of a gas or oil burner; the hot gases flowing countercurrent to the coke. The hydrocarbons expelled from the coke are partially burnt in the kiln and as a result supply much of the energy required in the process. The calcinate, under temperatures of from 1150° to 1350° C., drops into a rotary cooling drum where it is quenched with water. The off-gas escaping on the product inlet side of the kiln still contains combustible components (CO, $H_2$, hydrocarbons) and large quantities of coke dust. The gas has a temperature of from 500° to 800° C. depending on how the kiln is operated and on the water content of the charged material. This gas is called lean gas.

The treatment of said lean gas constitutes an important part of the entire process. In view of the environment protection provisions which are becoming increasingly stricter, a satisfying and economically acceptable solution to this problem will determine whether continuous petroleum coke calcining methods can also be carried out in the future.

Various methods are in use (see AUFBEREITUNG-STECHNIK No. 10/1972—"Die Entwicklung von grossen Drehrohröfen mit Nachbrennern zum Kalzinieren von Koks" (The Development of Large Cylindric Rotary Kilns with After-Burners for the Calcining of Coke)) comprising treating the lean gas by air and fuel admission in combustion chambers connected downstream from the cylindrical rotary kiln, in which chambers the combustible gases and a major portion of the dust are burnt. However, the off-gases even then contain enough remaining dust requiring an intensive separation of this dust by means of filters. This requirement is made difficult by the high temperature of the off-gas in excess of 600° C. Even when using the lean gas in the combustion chamber of a boiler in which the energy of the lean gas is utilized in combination with gas or oil burners for producing steam, the fine de-dusting of the off-gas exiting the combustion chamber at temperatures from 400° to 500° C. remains problematic. The gas volume, due to the temperature, is still very large, and the material of the largevolume filter must meet very high requirements, so that such an installation is expensive both in terms of equipment needed and operation costs. The cooling of the hot off-gases to a temperature permitting purification of the off-gas in textile hose filters is expensive and unprofitable. It is for this reason that installations have also been built in which a portion of the heat of the off-gas is used for drying the wet green coke. This procedure comprises withdrawing 20–40% of the hot boiler off-gases by means of a blower and contacting said gases directly and intensively with the green coke in a rotary drum. The gas leaving the rotary drum in such a direct drying process contains the vapors and has a temperature of 140°–170° C. This measure allows a reduction of the volume of the hot boiler off-gas if both gas streams are de-dusted separately, or the temperature of the total off-gas decreases to 280°–350° C. if the off-gas from the dryer is again admixed with the boiler gas.

The major disadvantage of the direct drying of green coke lies in the fact that the boiler off-gas used for such drying contains large amounts of green coke dust downstream of the dryer. This dust has the dangerous property that it may ignite under certain conditions even at temperatures of less than 100° C. The separation of said dust is highly dangerous because if failures or breakdown occur in the total system, air cannot be prevented from getting into the large-volume off-gas system, and this may cause fires or explosions in the off-gas conduits and the dust filter.

Although the dust problem has remained unsolved in connection with the use of direct green coke dryers, it was found that the use of dried green coke in the calcining kiln offers advantages for the overall controlling of the process in the kiln. The cylindrical rotary kiln may be shorter because if wet green coke is used, about 40% of the length of the kiln is required for the drying.

The temperature distribution in the kiln may be more readily controlled and maintained constant, a factor that has an important bearing on the quality of the calcinate. Furthermore, the use of dried green coke largely prevents the coke from caking upon the lining of the kiln within the inlet zone of the cylindrical rotary kiln. Such caked materials break off from time to time, causing material displacements within the kiln which considerably interfere with the calcining process and result in variations of the quality of the calcinate product.

An additional problem encountered in connection with hitherto employed calcining methods is the cooling of the hot calcinate. The direct cooling of the calcinate in a rotary drum by quenching with water produces substantial amounts of steam (about 10,000 $nm^3$ per 10 tons of calcinate) containing considerable amounts of dust (about 800–1000 $mg/nm^3$). The dust separation capabilities of cyclone dust separators as used up until the present time no longer satisfy recent environmental protection regulations. In a wet dust removal step, the reuse of the separated water containing calcinate dust would pose problems. Therefore, plants have been built in which the dust is removed jointly from both the vapors and the boiler off-gases in a central dust separation installation. This measure has the drawback that the vapor quantity varies considerably, which means that it is not possible to avoid pressure fluctuations within the entire flow passage or path of the gas. Pressure variations within the cylindrical rotary kiln, however, constantly cause changes in the temperature distribution within the kiln, and these changes have a negative bearing on the quality of the calcinate. Furthermore, said pressure variations cause vapors to enter into the chute or passageway between the kiln and the cooler, where said vapors react with the red-hot coke to form water gas especially if the product drops from the kiln with temperatures in excess of 1250° C. The subsequent combustion of the water gas severely damages the material by overheating within the product discharge zone of the kiln, the chute or passageway between kiln and cooler and the inlet zone of the cooler.

Furthermore, the water spray-nozzle system in the cooling drum was found to be susceptible to trouble and required considerable maintenance work.

Moreover, in view of the increasing demands relative to the quality of the calcinate, it is disadvantageous that the ash content in the calcinate increase depending on the salt content in the cooling water used. The rate of consumption or burningoff of electrodes manufactured from the calcinate is negatively influenced by the ash content and especially by the calcium content.

It is for these reasons that plants were also built in which the calcinate was cooled indirectly. The material drops into a rotary drum which rotates in an open water bath. The cooling water is maintained at a constant temperature by controlled cooling water admission and withdrawal. This type of indirect cooling has advantages over the direct cooling method; its drawbacks lie in the field of construction materials, corrosion, and a small heat exchange area.

SUMMARY OF THE INVENTION

Now, a method has been found which avoids the known shortcomings of the hitherto employed calcining methods with respect to green coke drying, calcinate quenching and off-gas treatment, which satisfies the increasingly higher demands with respect to the quality of the calcinate, and mainly permits compliance with environmental protection regulations that are becoming stricter and stricter with respect to dust emission control, so that only such compliance, to begin with, will allow the operation of a continuously working petroleum coke calcining plant.

A method was found of producing petroleum coke calcinate from wet green coke in a cylindrical rotary kiln comprising one-way gas flow for maintaining uniform process conditions relative to pressure and temperature, said method being characterized principally by the process steps of indirect drying, indirect cooling, central dust dosing and dust separation by means of an electro-filter. The invention also comprises an apparatus adapted to carry out the process.

BRIEF DESCRIPTION OF THE DRAWING

The drawing illustrates the apparatus flow sheet.

DESCRIPTION OF PREFERRED EMBODIMENTS

The process according to the invention is characterized by the following steps:

1. Drying wet green coke in a rotary dryer heated indirectly by boiler flue gas to a residual moisture content of about 0.5–7.0% by weight, and introducing the vapors containing green coke dust into a steam boiler;
2. Subsequently admitting said green coke into the calcining kiln and discharging said coke at the kiln outlet with a residual content of hydrocarbons of 0.1% by weight maximum and with a temperature of up to 1400° C. maximum;
3. Burning the countercurrently admitted heating gas together with the primary air introduced into the burner, thereby heating the coke and expelling part of the hydrocarbons contained in the green coke; simultaneously igniting and burning said hydrocarbons by the secondary air introduced into the upper portion of the head of the burner; and expelling and burning by said combustion energy the other part of the hydrocarbons contained in said green coke, in such a manner that the volume ratio between primary air and secondary air of about 1:1 to 1:2, together with the heating gas, maintains a constant temperature distribution across the length of the calcining kiln, with the maximum temperature being within the zone of the discharge half of said kiln;
4. Introducing the hot calcinate leaving step 2 at a temperature of from 1300°–1400° C. into a cooling zone by way of a stationary, partly brick-lined, water-cooled chute, and discharging said calcinate from said cooling zone with a temperature of from 100°–200° C., and maintaining a pressure difference of about 1–0.4 mbar between the outlet of the cylindrical rotary kiln and the cooler, thereby preventing external air from penetrating countercurrently into the calcinate within the zone of said chute, in order to avoid temperature increases within said chute and within the discharge zone of said calcining kiln and to keep down calcinate losses; and introducing into step 3 the flue gas aspirated towards said kiln because of said pressure difference, together with external air penetrating through the sealings of said cooler and the primary air and/or the secondary air;
5. Burning the off-gas of step 3 containing residuals of unburnt hydrocarbons, CO, $H_2$ (lean gas) and coke dust from green coke and calcinate by way of a dustcollecting chamber in said steam boiler in order to exploit the thermal and chemical energies for the generation of steam; partially calcining and partially burning the remaining amount of green coke dust by means of additional supporting burners; discharging the flue gas at about 400°–450° C., and feeding said flue for heating purposes to the indirect drying carried out in step 1;
6. Feeding the flue gas leaving the dryer with a temperature of about 200°–320° C. to an electro-filter; separating the coke dust; and discharging the off-gas with a remaining dust content of less than 100 $mg/nm^3$ (dry) by way of an exhauster;

7. Feeding the coke dust obtained in steps 1, 5 and 6 to a collecting receptacle, and admixing said dust in dosed quantities with the material charge downstream of said dryer, in order to provide a uniform or steady flow of the coke within the calcining kiln.

Other features of the process which may be included are as follows:

a. The temperature of the calcinate at the outlet of the cylindrical rotary kiln is controlled by the amount of heating gas admitted.
b. The gas temperature at the inlet of the cylindrical rotary kiln is controlled by the secondary air and/or underpressure in said calcining kiln.
c. The residence time of the coke in said cylindrical rotary kiln is controlled by adjusting the number of revolutions of between 0.5–2.5 r.p.m. at a kiln inclination set at an angle of about 3.5%.
d. The maximum temperature within the calcining zone is adjusted by the residence time in combination with the primary air.
e. The indirect cooler is operated within a closed cooling water system, whereby the re-cooling is carried out by air coolers.

The invention also comprises an apparatus for carrying out the method as illustrated in the drawing, characterized in that it comprises: an indirectly heated green coke dryer 1; a calcining kiln 2 with inlet chute 3 and one-way gas shutoff valve 4 toward said dryer for the dry green coke; a partially water-cooled discharge chute 5 for conveying the material into an indirect cooler 6, with connections 7, 8, 9 for feeding in heating gas, primary air and secondary air, respectively, and with a flue gas discharge conduit 10 leading to a steam boiler 11; an exhaust 12 on the indirect cooler 6 for flue gas and infiltrated air by an air-operated injector 13; a dust-collecting chamber 14 with dust-transporting devices 15 on the lower conical portion of the chamber with draft-regulating slide or gate 16 for controlling the pressure within the rotary kiln 2; a heating gas burner 17 for supporting fire and heavy-duty burners 18 disposed on a plurality of planes, and with air blowers 19 for combustion air and a blower 20 for sucking-off the vapors from said indirect dryer 1 by way of a vapor conduit 21; an electro-filter 22 for separating the dust from the flue gas, said filter comprising a screw 23 for withdrawing dust on the lower conical portion of said electrofilter; an exhauster 24 and an off-gas smokestack 25 a dust-collecting receptacle 26 for receiving dust from the dust-depositing chamber 14, the indirect dryer 1 and the electro-filter 22 and comprising a dosing screw 27 and transporting devices 28 for feeding the dust into the inlet chute 3 of the calcining kiln 2.

An additional feature of the apparatus is that said discharging chute 5 is provided with a stair within its upper brick-built portion, so that the calcinate breaks apart, thereby preventing material wear on said chute and feeding said calcinate to indirect cooler 6 by way of the water-cooled portion of said chute.

Another feature of the apparatus is that the brick-lining of the calcining kiln within the inlet zone and within the calcining zone is provided in the form of a ridged lining extending over a length of about $\frac{1}{3}$ to $\frac{2}{3}$ (one third to two thirds) of the kiln length.

The wet green coke is dried in the indirect dryer 1 which is heated by the off-gas of the boiler 11. The energy of the lean calcining gas is exploited in said boiler for the generation of steam. Said dryer is a cylindrical or tubular dryer capable of being adjusted during its operation with respect to its number of revolutions; the coke is conveyed in said dryer by the rotary motion. Said dryer rotates within a chamber through which the boiler flue gas is flowing (Manufacturer: The firm Büttner-Schilde-Haas). The vapors charged or loaded with readily combustible green coke dust are withdrawn at the dryer outlet by means of the blower 20 and fed into the combustion chamber of the boiler where said dust is burnt. Downstream from said dryer, dust is added in uniformly dosed amounts to the green coke which has been dried to a maximum water content of 5%. Said dust is withdrawn from the dust-depositing chamber 14 downstream from the cylindrical rotary kiln 2, from the electro-filter 22 and the gas side of the green coke dryer, and collected in a receptacle 26 from which it is dosed. The dosed addition of dust has a special bearing on the uniform formation of the coke bed within the calcining kiln. The mixture comprising dried green coke and dust is passed into the cylindrical rotary kiln 2 in which the material is guided countercurrently into a stream or flow of hot gas. On the product discharge side, the kiln is heated by a gas or oil burner. Combustion air is admitted by way of a blower at two points on the burner head, namely as primary air directly on the burner and as secondary air above said burner. A portion of the hydrocarbons escaping from the coke is burnt in the cylindrical rotary kiln with the help of said secondary air, whereby the major portion of the energy required for carrying out the process is obtained. The temperature distribution across the entire length of the kiln is adjusted by the ratio between primary air and secondary air and by the suction within the kiln.

The finished product drops at a temperature of from 1250° to 1350° C. into the indirect rotary cooler 6 by way of the partially brick-built, partially water-cooled chute 5, and is guided or passed within said cooler through a cooling section circum-circulated by water, the heated cooling water is cycled from a collecting receptacle 31 by way of an air cooler 33 back into the calcinate cooler. The heat of the calcinate is thus discharged into the air. The cooling of the chute is connected to said circulation. The calcinate exits from the cooler at a temperature of 100°–150° C. The lean gas from the cylindrical rotary kiln is passed by way of the dust-depositing chamber 14 in which the coarse dust particles are deposited, and into the combustion chamber of the boiler which is equipped on a plurality of planes with gas- or oil-operated supporting and heavy-duty burners 17, 18 and supplied with combustion air by way of blower 19. The combustible gases (CO, $H_2$, hydrocarbons) are burnt within said combustion chamber. The portions of the dust containing the particularly readily combustible hydrocarbon residuals are partially burnt and partially removed by calcination. The energy obtained is used for the generation of steam. Variations in the energy content of the lean gas are compensated by the heavy-duty burners which are adjusted accordingly, so that the boiler can be operated under steady load. Including the output of the supporting and heavy-duty burners, from 2.6–2.9 tons of steam with a heat output of 2970 j/kg steam are generated per each ton of dry green coke charged. The off-gas having a temperature of 400°–500° C. passes downstream from the boiler into the indirect dryer 1 and from there at a temperature of from 280°–320° C. into the electro-filter 22. Since the entire dust contained in the off-gas is passed through the combustion chamber of the boiler, said dust contains only traces of hydrocarbons; furthermore, it is not readily combustible, and may be very readily separated electrostatically.

Therefore, combined with the relatively low temperature of the off-gas, conditions are provided allowing the filter to be constructed relatively small and thus at low cost. The residual dust content of the off-gas downstream from the filter is less than 100 mg/nm$^3$ $t_r$ and complies with environmental protection regulations. Downstream from said filter, the purified off-gas is discharged by way of an exhauster into the smokestack at a temperature of less than 300° C.

The method according to the present invention offers the following advantages over the procedures employed according to the present state of the art:

Only a single gas stream is practically needed extending from the cylindrical rotary kiln by way of the boiler, the dryer and the electro-filter to the exhauster, and said passage or one-way flow of the gas may be safely controlled with respect to pressure and and temperature conditions, thereby providing a prerequisite for a consistently good quality of the calcinate.

In the lean gas treatment, the energy of the gas is optimally exploited or utilized for the generation of steam as well as for the drying of the green coke. The dust contained in the gas is not readily combustible and capable of being readily separated by electrostatic means. Combined with the relatively low off-gas temperature downstream from the dryer, thus the conditions are provided for a safe and intensive off-gas purification that satisfies the environmental protection regulations.

Because of the use of dried green coke charged in the cylindrical rotary kiln, this part of the production plant may be built smaller, whereby the processing operation may be controlled more easily. Caking within the inlet zone of the cylindrical rotary kiln is largely avoided.

The separated dust is added in uniformly dosed quantities to the charge of the cylindrical rotary kiln. Thus an important prerequisite for a uniform calcining process is provided because the fine-grain proportion in the charged material strongly influences the flow behavior of said material within the cylindrical rotary kiln.

Due to the indirect cooling and the absence of vapors, the volume of the off-gas to be de-dusted is 15–20% smaller than in connection with a direct cooling step. The ash content of the calcinate is lower, and the quality of the calcinate, therefore, is superior. The closed cooling system permits the use of fully de-salted water as cooling water, which possibility offers advantages with respect to corrosion and contamination of the cooling system.

The method according to the present invention is divided in the following processing lines described hereinafter by way of example.

1. Coke Processing Line

The green coke is fed to the indirect green coke dryer 1 by way of conveying devices. Said conveying devices are switched in such a way that the green coke dryer may be by-passed in case of failure or breakdown. The green coke is passed from said dryer into the calcining kiln 2. This calcining kiln may be rotated at various speeds by means of a hydrostatic drive, thus permitting changing the residence time of the coke in the calcining kiln. The inclination of the calcining kiln is adjusted to the rotation speed. Within the calcining zone and the inlet zone, the lining of the calcining kiln is provided in the form of a ridged lining which provides for optimal turning around of the coke bed. The chute disposed on the outlet of the calcining kiln is provided with an upper brick-built portion having a stair configuration, so that calcinate drops onto calcinate, thereby reducing wear on the material to a minimum. The transitional passageway leading to the indirect cooler 6 is water-cooled. Said indirect cooler 6 is a sectional cooler cooled by a stream of cooling water and always filled with cooling water up to its center axis of the cooling space. The calcinate enters in said cooler with a temperature of about 1250°–1350° C. and exits from said cooler with a temperature of from 100°–150° C., and is subsequently conveyed into the calcinate bunker station by means of conveying devices.

2. Gas Processing Line

The gas processing line starts at the burner and air admission point on the product discharge side of the cylindrical rotary kiln. This line extends by way of the kiln 2, the boiler 11, the indirect dryer 1 and electro-filter 22 to exhauster device 24. Said exhausting device produces an underpressure over the entire length of the gas line, which underpressure is in each case maintained at a constant level as required under the applicable processing conditions, namely with the help of adjustable shutters or traps provided in the rotary kiln and in the combustion chamber of the boiler. Downstream from the exhauster, the off-gas is passed into smokestack 25. The cylindrical rotary kiln is preferably heated with a gas such as natural gas, refinery gas etc., but may also be heated with heating oil. The combustion air is admitted by way of a blower. The temperature of the calcinate within the discharge zone of the cylindrical rotary kiln is controlled by the amount of fuel used (approx. 1250°–1350° C.). The combustion air is divided into primary air which is directly introduced into the burner, and secondary air blown into the upper portion of the head of the kiln burner. The secondary air serves for partially burning the hydrocarbons expelled from the green coke within the rotary kiln. Therefore, it is possible to control the off-gas temperature on the product inlet side of the cylindrical rotary kiln within a practically sufficient range. A defined underpressure is maintained within the cylindrical rotary kiln by means of the draft-regulating slide or gate 16. By adjusting the underpressure and the distribution of primary and secondary air, it is possible to control the distribution of the temperature within the cylindrical rotary kiln in such a manner that an optimal quality of the calcinate may be achieved. A portion of the combustion air is passed through the injector 13 on the pressure side of the combustion air blower. Said injector sucks-off air from the indirect cooler on the product discharge side of said cooler, which air infiltrates through various leaky spots. Due to the underpressure present in the cylindrical rotary kiln in accordance with the pressure drop, said external or infiltrating air would flow from the cooler through the transitional chute towards the rotary kiln and countercurrently to the red-hot calcinate, and would consequently cause high temperatures and damages on the chute. The suction power is adjusted in such a way that a weak pressure drop develops between or from the cylindrical rotary kiln towards the cooler. The sucked-off air/flue gas mixture is fed to the cylindrical rotary kiln by way of the primary air. The off-gas of the rotary kiln contains combustible gases (CO, $H_2$, hydrocarbons) and much dust. Said off-gas, which is also called lean gas, passes first through the dust-depositing chamber 14 where the heavy dust particles will deposit, and is subsequently passed at a temperature of from 600°–800° C. into the boiler 11 by way of a reversing valve 29.

Under extraordinary operating conditions (start-up and shutdown operations, boiler shutdown etc.), the lean gas may also be passed into the smokestack directly with the help of said reversing valve. Said smokestack is provided with supporting burners which, in such cases, will burn the major portion of the dust and the combustible gases. The boiler is provided with supporting and heavy-duty burners disposed on a plurality of planes, which burners may be operated with gas or oil. The combustion air is admitted by way of blowers. The air and fuel supplies of said supporting and heavy-duty burners are controlled in such a manner that the combustible gaseous components contained in the lean gas and the readily combustible dust particles will be burned, the off-gas will no longer contain any CO and only about 2–4% by volume oxygen, and that the boiler is operated under steady steam load. The hot boiler off-gases having a temperature of about from 400° to 500° C. are passed into the indirect green coke dryer by way of conduit 30. In case of failure or repairs needed on said dryer, the gas may by-pass said dryer by way of a bypass conduit. When passing through the dryer, the boiler gas is cooled to a temperature of from 280° to 320° C. The wet green coke is dried by the heat given off in said step, while the water content of said green coke is reduced from about 12–20% to 0.5 to 5%. The vapors are sucked off on the product discharge side by means of a blower 20. Said vapors contain a substantial quantity of highly combustible green coke dust, and are therefore passed downstream from said blower into the combustion chamber of the boiler in which said dust is eliminated by combustion. Downstream from the dryer, the cooled off-gas passes through the electro-filter. The entire amount of dust contained in the off-gas is passed through the combustion chamber of the boiler, therefore, the content of residual hydrocarbons in the coke dust is very low, and the dust is difficult to ignite. Furthermore, since the off-gas has a relatively high content of steam, the conditions are provided for a safe electrostatic separation of the dust. The residual dust content of the off-gas downstream from the filter meets the environmental protection regulations. Downstream from said filter, the off-gas is discharged into the smokestack or flue at temperatures of less than 300° C. by way of exhauster device 24.

3. Dust Processing Line

The largest quantity of dust obtained in the course of the process is collected or obtained in the dust-depositing chamber 14 downstream from the product inlet side of the cylindrical rotary kiln and in the electro-filter 22. The quantity of dust separated on the gas side of the indirect dryer is only very small. In accordance with the spatial arrangement of the single dust-separating installations relative to each other, the dust is conveyed to a dust-collecting receptacle 26 by means of mechanical or pneumatic conveying devices. From said dust-collecting receptacle, the dust is added in dosed quantities to the dried green coke between the indirect dryer and the rotary kiln inlet by means of a dosing screw 27 and a mechanical conveying device.

The addition of the dust to the rotary kiln charge in uniform quantities is preferably an essential feature of the method according to the present invention. The fine-grain proportion of the charged material has a bearing on the flow behavior of the coke within the cylindrical rotary kiln.

However, it is possible also to add the dust collected in said dust-collecting receptacle 26 totally or partially in dosed quantities to the combustion air of the cylindrical rotary kiln by means of a pneumatic conveying device. However, this will make it more difficult to control the temperature within the kiln; furthermore, a larger quantity of dust will be burned which would reduce the calcinate yields.

4. Indirect Cooling System

The cooling system comprises a cooling water reservoir 31, the cooling water pump 32 and the air cooler 33. As cooling water, fully de-salted boiler feeding water is used. This will practically prevent corrosion and contamination within the cooling system. The enclosed cooling system also permits the use of other cooling liquids. The system is protected against admission of air oxygen by means of an immersed siphon 34. In case of a breakdown of the circulation pump 32, the system is automatically switched to hydrant water supply. This water is always available at sufficient pressure. The cooler is manufactured by the firm Büttner-Schilde-Haas.

We claim:

1. Apparatus for calcining petroleum coke comprising in combination an indirectly heated rotating green coke dryer having its discharge end connected to the intake chute of a calcining rotary kiln with a one-way valve permitting gas to flow from said dryer to said intake chute and this intake end of the kiln also being connected to a dust depositing chamber and a lean gas discharge line; an electro-filter connected to said dryer with further means connected to a dust collecting receptacle; a vapor conduit lead with blower from said dryer to a steam boiler; a valve regulator between said kiln and said boiler; means for supplying heating gas, primary air and secondary air to said kiln; said dust depositing chamber connected by means of a dust transporting means to a dust collecting receptacle; a secondary air inlet means for said kiln located on the product discharge end over a burner means; a partly water-cooled brick-lined discharge chute connected to said kiln conveying material from said kiln into an indirectly cooled rotating cooler; an exhaust gas line from said cooler connected to an air-operated injector leading back to the burner in said kiln; means for conducting heated cooling water from said cooler to an air cooler and recirculating the same water into the indirect cooler; connecting said boiler by conduit connection with said indirect dryer and by a further conduit to said electro-filter from which a gas exhaust line connects to a smokestack.

2. Apparatus as in claim 1, wherein said discharge chute is provided with an upper brick-built portion having a stair configuration, so that calcinate drops onto calcinate, thereby lessening material abrasion wear on said chute, and so that said calcinate is fed to said indirect cooler at the water-cooled portion of said chute.

3. Apparatus as in claim 1, wherein the calcining kiln within the inlet zone and the calcining zone, is provided with a ridged lining extending over a length of about one third to two thirds of the length of the kiln.

* * * * *